US011328914B1

(12) United States Patent
Shermer

(10) Patent No.: US 11,328,914 B1
(45) Date of Patent: May 10, 2022

(54) DISCHARGE REDUCTION IN SEALED COMPONENTS

(71) Applicant: Baker Hughes Oilfield Operations LLC, Houston, TX (US)

(72) Inventor: Scot Alan Shermer, Chesterland, OH (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/093,837

(22) Filed: Nov. 10, 2020

(51) Int. Cl.
*H01J 43/30* (2006.01)

(52) U.S. Cl.
CPC ..... *H01J 43/30* (2013.01)

(58) Field of Classification Search
CPC ..... H01J 43/30
See application file for complete search history.

(56) References Cited

U.S. PATENT DOCUMENTS

| | | | |
|---|---|---|---|
| 6,917,512 | B2 | 7/2005 | Hongu et al. |
| 8,158,953 | B1 | 4/2012 | Friedman |
| 9,774,131 | B2 | 9/2017 | Painter et al. |
| 10,416,198 | B2 | 9/2019 | Marchese et al. |

FOREIGN PATENT DOCUMENTS

| | | | |
|---|---|---|---|
| WO | 2004100206 | A1 | 11/2004 |

OTHER PUBLICATIONS

"Larger Current, Higher Voltage", ROHM Semiconductor USA, LLC, Jun. 8, 2020.

*Primary Examiner* — Joseph L Williams
(74) *Attorney, Agent, or Firm* — Mintz Levin Cohn Ferris Glovsky and Popeo, PC; Lisa Adams

(57) ABSTRACT

Systems and methods for partial discharge reduction are provided. The systems and methods can receive an input voltage at a high voltage sensor configured within a sealed sensor assembly. The input voltage can be received via a discharge reduction of the sealed sensor assembly. The discharge reduction circuit can reduce an incidence of discharge associated with an ionization breakdown of an air gap between an output circuit of the sealed sensor assembly and an insulator conveying the output circuit through a hermetic barrier of the sealed sensor assembly.

20 Claims, 2 Drawing Sheets

DISCHARGE REDUCTION IN SEALED COMPONENTS

BACKGROUND

Sealed electrical components, such as photomultiplier tubes, can experience spurious, partial discharges due to high voltage stress occurring at one or more locations within the component. The discharges can mimic the intended signals generated by the component, thereby making it difficult to accurately ascertain the intended signal values from signals values produced as a result of partial discharges within the sealed component. Mitigating and reducing spurious, partial discharges can be desirable to ensure that signal values generated by sealed electrical components are accurate.

SUMMARY

In one aspect, a system for reducing partial discharges is provided. In one embodiment, the system can include a sealed sensor assembly including a hermetic barrier, a high voltage sensor, an input circuit configured to provide an input voltage to the high voltage sensor, and an output circuit configured to provide an output voltage to a data processor. The system also includes a discharge reduction circuit configured within the sealed sensor assembly to receive the input voltage for provision to the high voltage sensor via the input circuit and to provide the output voltage to the data processor via the output circuit. The output voltage can be indicative of an output signal corresponding to a quantum of light received at the high voltage sensor. The discharge circuit can be configured to reduce an incidence of discharge associated with an ionization breakdown of an air gap between the output circuit and a first insulator conveying the output circuit through the hermetic barrier to the data processor.

In another embodiment, the discharge reduction circuit can include a bias resistor and a coupling capacitor. The bias resistor can be configured between an input of the high voltage sensor and an output of the high voltage sensor. The coupling capacitor can be configured between an output of the bias resistor and a pin of the first insulator conveying the output circuit through the hermetic barrier of the sealed sensor assembly.

In another embodiment, the high voltage sensor can include a scintillator and a photocathode and the sealed sensor assembly includes a photomultiplier tube. The photomultiplier tube can include a pressurized gas. In another embodiment, the input voltage is provided by a high voltage power source coupled to the input circuit. The high voltage power source can be configured to supply the input voltage between 250-2000 V. In another embodiment, the sealed sensor assembly can include a second insulator conveying the input circuit from the high voltage power source through the hermetic barrier. In another embodiment, the hermetic barrier can be formed from a material including one of a silicon dioxide, a magnesium dioxide, a ceramic, or a combination thereof.

In another aspect, a method for reducing partial discharges is provided. In one embodiment, the method can include receiving an input voltage at a high voltage sensor configured within a sealed sensor assembly. The input voltage can be received via an input circuit coupling the high voltage sensor and a discharge reduction circuit configured within the sealed sensor assembly. The discharge reduction circuit can be configured to provide the input voltage to the high voltage sensor. The method can also include providing an output voltage of the high voltage sensor via the discharge reduction circuit. The output voltage can be provided via an output circuit coupling the high voltage sensor to a data processor via the discharge circuit. The output voltage can be indicative of an output signal corresponding to a quantum of light received at the high voltage sensor. The discharge reduction circuit can be configured within the sealed sensor assembly to reduce an incidence of discharge associated with an ionization breakdown of an air gap between the output circuit and a first insulator conveying the output circuit through a hermetic barrier of the sealed sensor assembly to the data processor.

In another embodiment, the discharge reduction circuit can include a bias resistor and a coupling capacitor. The bias resistor can be configured between an input of the high voltage sensor and an output of the high voltage sensor. The coupling capacitor can be configured between an output of the bias resistor and a pin of the first insulator conveying the output circuit through the hermetic barrier of the sealed sensor assembly.

In another embodiment, the high voltage sensor can include a scintillator and a photocathode and the sealed sensor assembly includes a photomultiplier tube. The photomultiplier tube can include a pressurized gas. In another embodiment, the input voltage is provided by a high voltage power source coupled to the input circuit. The high voltage power source can be configured to supply the input voltage between 250-2000 V. In another embodiment, the sealed sensor assembly can include a second insulator conveying the input circuit from the high voltage power source through the hermetic barrier. In another embodiment, the hermetic barrier can be formed from a material including one of a silicon dioxide, a magnesium dioxide, a ceramic, or a combination thereof.

DESCRIPTION OF DRAWINGS

These and other features will be more readily understood from the following detailed description taken in conjunction with the accompanying drawings, in which.

Figure 1:
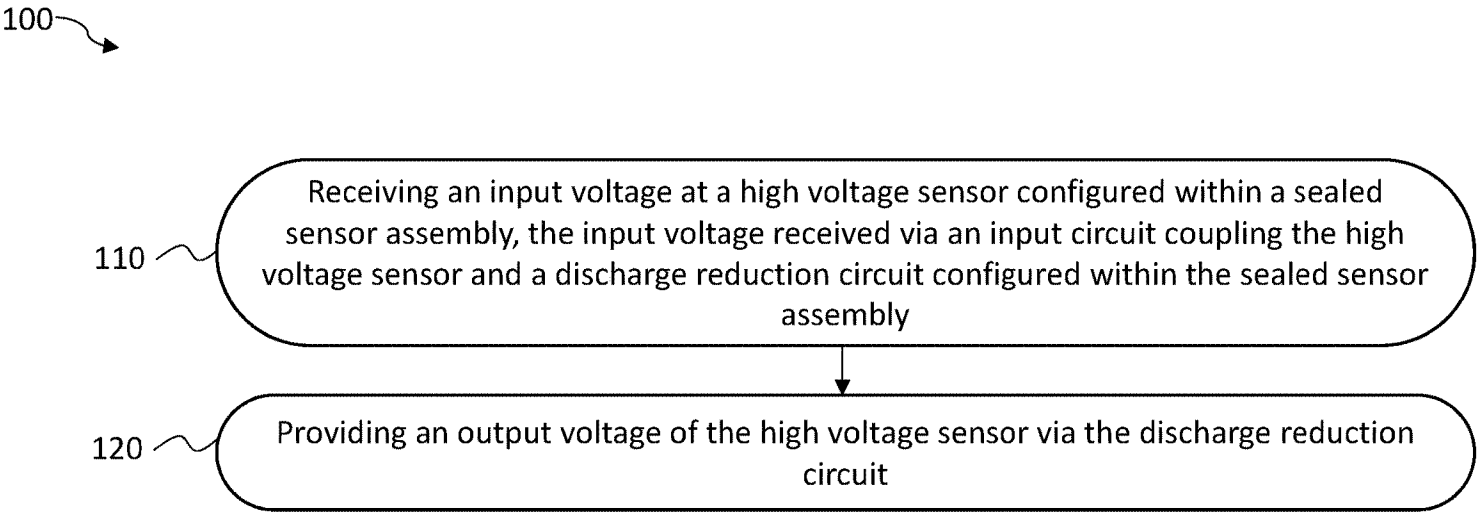
FIG. 1 is a process flow diagram illustrating an example process for reducing partial discharges in an output of a sensor via a discharge reduction circuit according to some implementations of the current subject matter.

It is noted that the drawings are not necessarily to scale. The drawings are intended to depict only typical aspects of the subject matter disclosed herein, and therefore should not be considered as limiting the scope of the disclosure.

DETAILED DESCRIPTION

Photomultiplier tubes can include vacuum sealed components configured to detect light in the ultraviolet, visible and near-infrared range of the electromagnetic spectrum. Photomultiplier tubes can include sensors therein configured to receive light energy and to convert the light energy into an output signal. Photomultiplier tubes are well-suited for applications requiring low-noise and high-sensitivity detection of light.

The output signal of photomultiplier tubes and the sensors configured therein that generate the output signal can be altered due to the incidence of partial discharges that can occur within the sealed portion of the photomultiplier tube. For example, partial discharges of electrical energy can occur between a high voltage biased signal pin of an insulator configured within a sealed assembly of the photomultiplier tube and a ground, such as a chassis ground of the photomultiplier tube.

The discharges can be caused by an ionization breakdown of an air gap present in the insulator. The air gap can be present between a wire or pin of an insulator conveying the sensor output signal through the seal of the photomultiplier tube and the insulator in which the wire of pin is configured. In high voltage applications, this location can experience very high voltage stress which can lead to the ionization breakdown and produce periodic discharges which can add noise to the output signal. As the voltage builds in these locations, a critical threshold is passed, above which, charge begins to flow at a high transfer rate in a gap formed between the wire or pin conveying the high voltage output signal and an inner surface of the insulator. Such discharges are especially prevalent in high temperature applications. These charges can mimic or simulate the actual output signal of the sensor configured within the photomultiplier tube. As a result, the accuracy, performance, and reliability of the sensor and the photomultiplier tube can be degraded and can result in false output signals which are not truly indicative of the light being detected by the photomultiplier tube sensor.

The discharges can be mitigated by adding insulation around the seal of the photomultiplier tube, however, these methods can be labor intensive, time consuming, and require extensive quality assurance testing to verify the insulation is properly configured. The discharges can also be reduced by operating the photomultiplier tube in a negative high voltage mode which can cause the output signal circuit of the sensor to become a ground. This can unnecessarily complicate the physical design fo the photomultiplier tube and can reduce the volume of a scintillator crystal configured therein, which can reduce the performance of the photomultiplier sensor configured therein.

An example system and methods for reducing partial discharges in an output of a sensor of a sealed sensor assembly via a discharge reduction circuit are provided herein. The system and methods herein can be configured to reduce the incidence of partial discharges between a sensor signal output circuit and a signal ground in a wide range of temperature applications. The discharge reduction circuit can advantageously be configured within the sealed sensor assembly, such as a photomultiplier tube, to reduce the partial discharges. By implementing the discharge reduction circuit within the sealed photomultiplier tube, the high voltage sensor output can be converted to a low voltage output for which the incidence of discharged is prevented or reduced. The system and method described herein can provide a highly integrated sealed sensor assembly, such as a photomultiplier tube, which is more reliable and less prone to erroneous gamma count rates. Additionally, the configuration of the discharge reduction circuit within the sealed sensor assembly can simplify preamplifier/amplifier/discriminator circuitry configured outside of the sealed sensor assembly. This configuration can provide a further benefit of reducing scrap materials in assembled sealed sensor assemblies. Costs reductions can also be achieved by implementing the discharge reduction circuit on surface mounted components within the sealed sensor assembly, such as a printed circuit board (PCB) and by reducing the number of penetrations through the seal or barrier of the sealed sensor assembly.

FIG. 1 is a process flow diagram illustrating an example process 100 for reducing partial discharges in an output of a sensor via a discharge reduction circuit according to some implementations of the current subject matter. At 110, a high voltage sensor, can receive an input voltage. The high voltage sensor, such as a photomultiplier and a scintillator, can be configured within a sealed portion of a sealed sensor assembly, such as a photomultiplier tube. The input voltage can be received via an input circuit configured to couple a high voltage power source providing the input voltage to the high voltage sensor via a discharge reduction circuit configured within the sealed sensor assembly.

At 120, the high voltage sensor can provide an output voltage via the discharge reduction circuit. The output voltage can be provided via an output circuit coupling the high voltage sensor to a data processor via the discharge reduction circuit configured within the sealed sensor assembly. The output voltage can be indicative of an output signal corresponding to a quantum of light received at the high voltage sensor. The discharge reduction circuit can be configured to reduce an incidence of discharge associated with an ionization breakdown of an air gap present between the output circuit and an insulator conveying the output circuit through a hermetic barrier of the sealed sensor assembly to the data processor.

Figure 2:
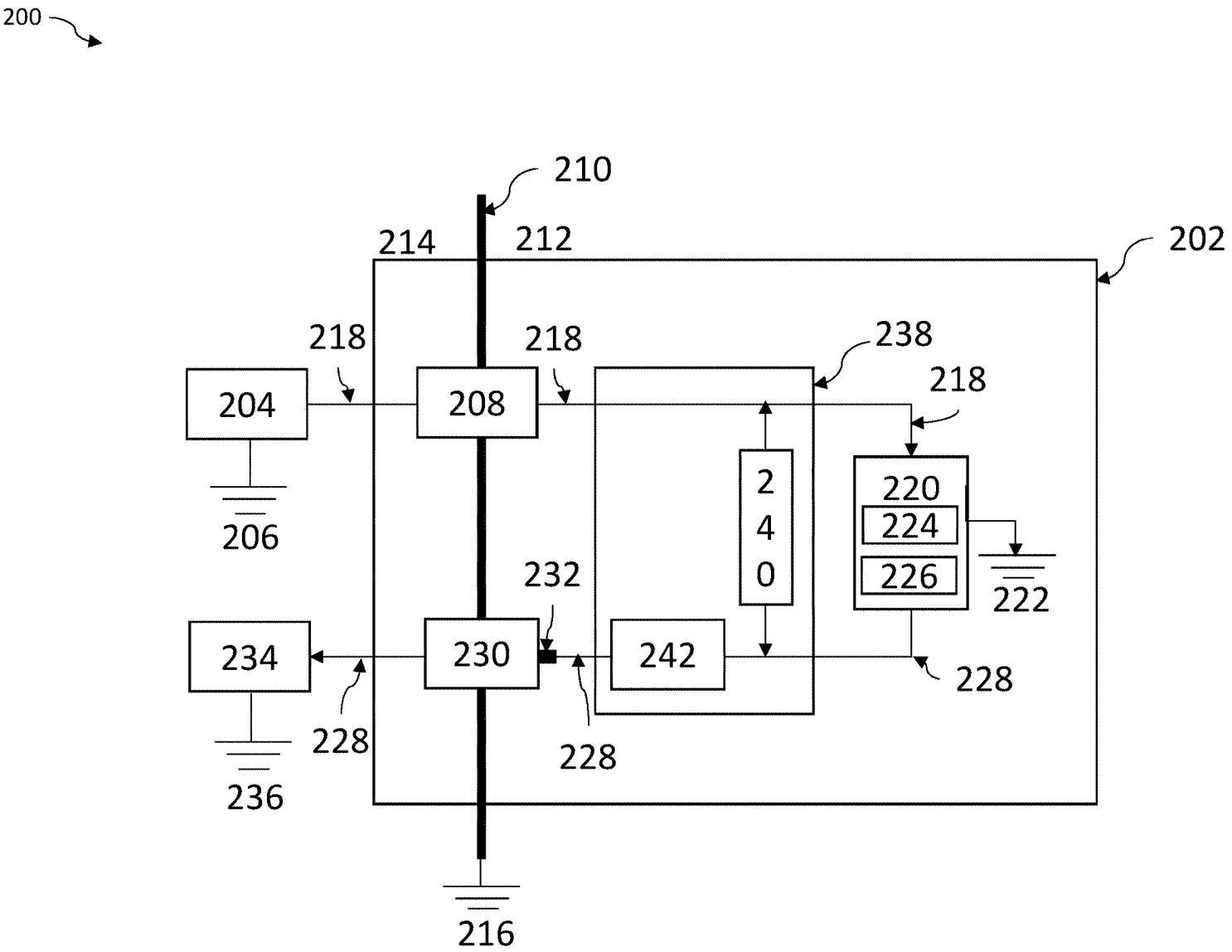
FIG. 2 is a block diagram illustrating an example system including a discharge reduction circuit configured to perform the process of FIG. 1 according to some implementations of the current subject matter.

FIG. 2 is a block diagram illustrating an example system 200 including a discharge reduction circuit configured to perform the process of FIG. 1 according to some implementations of the current subject matter. The system 200 includes a sealed sensor assembly 202. For example, the sealed sensor assembly 202 can include a photomultiplier tube, a gas filled detector, or the like. The sealed sensor assembly 202 can be configured for high-voltage applications capable of handling 250-2000 V DC. High voltage inputs can be provided by a high voltage power source 204. The high voltage power source 204 can include a ground 206. The high voltage power source 204 can be configured to provide a high bias voltage to a sensor configured within the sealed sensor assembly 202.

As shown in FIG. 2, the high voltage power source 204 can provide an input to the sealed sensor assembly 202 via an input insulative pass-through 208. The insulative pass-through 208 can include an insulative material, such as silicon dioxide, magnesium dioxide, a ceramic material and/or a combination thereof. The insulative pass-through 208 can include a wire coupling an input pin and an output pin. The wire and/or the pins can be brazed within or through the insulative pass-through to convey a high voltage input to a sensor configured within the sealed sensor assembly 202. The insulative pass-through 208 can be formed to pass through a seal 210, such as a hermetic barrier, configured to define a sealed portion 212 and an atmospheric portion 214 of the sealed sensor assembly 202. The insulative pass-through 208 can be brazed within the seal 210. In some embodiments, the sealed portion 212 can contain a pressurizes gas, such as an inert gas, air, or nitrogen. The seal 210 can be formed in a chassis of the sealed sensor assembly 202. The sealed sensor assembly 202 can also include an assembly ground 216.

As shown in FIG. 2, the high voltage power source 204 can provide an input voltage via an input circuit 218. The input circuit 218 can couple the high voltage power source 204 to an input pin of the insulative pass-through 208 configured at the atmospheric portion 214 of the sealed sensor assembly 202. The input circuit 218 can further provide the input voltage via an output pin of the insulative pass-through 208 to the high voltage sensor 220.

The high voltage sensor 220 can receive the input voltage via the input circuit 218. The input voltage can provide power to the high voltage sensor 220. The high voltage sensor 220 can include a sensor ground 222. The high voltage sensor 220 can also include a scintillator 222 and a photocathode 224. The scintillator 222 can re-emit absorbed light energy received from a light source. The photocathode 224 can receive the light energy from the scintillator 222 and can convert the light energy into an electrical signal. The high voltage sensor 220 can be configured to generate an output signal, such as an output voltage. The output voltage can be indicative of the output signal. The output signal can correspond to a quantum of light received at the high voltage sensor 220. In some embodiments, the high voltage sensor 220 can include a photodiode or a photomultiplier [Scot-any other sensor types to describe?]

As shown in FIG. 2, the high voltage sensor 220 can provide an output signal via an output circuit 228. The output circuit 228 can convey the output signal through an insulative pass-through 230 configured within the seal 210 of the sealed sensor assembly 202. The insulative pass-through 230 can be brazed within the seal 210. The insulative pass-through 230 can be configured similarly to the insulative pass-through 208. For example, the insulative pass-through 230 can include an insulative material, such as silicon dioxide, magnesium dioxide, a ceramic material and/or a combination thereof. The insulative pass-through 230 can include a wire coupling an input pin 232 and an output pin. The wire and/or the pins can be brazed within or through the insulative pass-through 232 to convey an output voltage indicative of an output signal of the high voltage sensor 220. The insulative pass-through 230 can be formed to pass through the seal 210.

As shown in FIG. 2, the output circuit 228 can further provide the output voltage to a data processor 234. The data processor 234 can be configured within a computing device coupled to the high voltage sensor 220 via the output circuit 228. The computing device can include a ground 236 and non-transitory computer readable and executable functionality configured to execute programmatic instructions to analyze and provide data associated with the high voltage sensor 220 and the output signal.

As further shown in FIG. 2, the sealed sensor assembly 202 can include a discharge reduction circuit 238. The discharge reduction circuit 238 can be configured within the sealed portion 212 of the sealed sensor assembly 202. For example, in some embodiments, the discharge reduction circuit 238 can be provided within the sealed sensor assembly 202 on a printed circuit board that is directly coupled to the respective input and output pins of the insulative pass-throughs 208 and 230. The high voltage sensor 220 can include one or more wires to connect it to the input circuit 218 and to the output circuit 228. In some embodiments, the discharge reduction circuit 238 can be coupled to the wires of the high voltage sensor 220. In some embodiments, the wires of the high voltage sensor 220 can be directly coupled to the components configured within the discharge reduction circuit 238.

As shown in FIG. 2, the discharge reduction circuit 238 can include a bias resistor 240 and a coupling capacitor 242. The bias resistor 240 can be coupled to the input circuit 218 and to the output circuit 228. The bias resistor 240 can control the amount of current provided to the high voltage sensor 220 via the input circuit 218. In this way, a minimum amount of current necessary to power the high voltage sensor 220 is received by the high voltage sensor 220. The coupling capacitor 242 can be coupled to the output circuit 228 and to an input pin 232 of the insulative pass-through 230. The coupling capacitor 242 can be configured to connect two circuits such that the signal from one circuit is blocked while the signal from a second circuit is allowed to pass through. The coupling capacitor 242 can help isolate DC bias settings of two coupled circuits.

The discharge reduction circuit 228 can reduce or mitigate partial discharges from the high voltage output signals conveyed via the output circuit 228. The partial discharges can occur in high voltage stress areas and can mimic the output signals normally generated by the high voltage sensor 220. For example, the partial discharges can occur at high voltage stress areas such as air gaps present between insulative pass-throughs and wires/pins configured within the seals of sealed sensor assemblies. Configuring the discharge reduction circuit 238 within the sealed sensor assembly 202, as shown in FIG. 2, can advantageously cause the output voltage received at the input pin 232 of the insulative pass-through 230 to be a low voltage output signal. As a result, the risk and incidence of partial discharges occurring due to high voltage stress at or within the insulative pass-through 230 are reduced. The bias resistor 240 can be used to set a charge on the high voltage output 228 of the photomultiplier tube 202 and the high voltage side of the coupling capacitor 242. This charge can be transferred across the capacitor 240 on the output of a charge pulse from the photomultiplier tube 202. The bias resistor 240 can determine a decay rate of the output pulse after a sharp negative going pulse is generated across the coupling capacitor 242. The circuitry on the low-voltage side of the coupling capacitor 242 can include a charge-sensitive amplifier whose input can be at essentially ground. As a result, a pin passing through the hermetic seal can be at ground potential and cannot generate spurious noise pulses which can be reduced or eliminated using the system and methods described herein.

Exemplary technical effects of the methods and systems described herein include, by way of non-limiting example, reducing partial discharges in an output of a high voltage sensor configured within a sealed sensor assembly. By configuring a discharge reduction circuit including a bias resistor and a coupling capacitor within the sealed sensor assembly, the output signal of the high voltage sensor can be converted to from a high voltage signal to a low voltage signal. As a result, an amount of high voltage stress in or around an insulative pass-through conveying an output circuit of the high voltage sensor can be reduced and the presence of partial discharges mimicking the intended output signals of the high voltage sensor can be eliminated so that the resulting output signal is advantageously more precise in regard to the stimulus observed by the high voltage sensor. Thus, the sealed sensor assembly described herein can provide more accurate output signals from a high voltage sensor configured therein and can further provide a means of operational protection to the high voltage sensor, the insulative pass-throughs, the seal, and any electronics coupled to the sealed sensor assembly.

Certain exemplary embodiments have been described to provide an overall understanding of the principles of the structure, function, manufacture, and use of the systems, devices, and methods disclosed herein. One or more examples of these embodiments have been illustrated in the accompanying drawings. Those skilled in the art will understand that the systems, devices, and methods specifically described herein and illustrated in the accompanying drawings are non-limiting exemplary embodiments and that the scope of the present invention is defined solely by the claims. The features illustrated or described in connection with one exemplary embodiment can be combined with the features of other embodiments. Such modifications and variations are intended to be included within the scope of the present invention. Further, in the present disclosure, like-named components of the embodiments generally have similar features, and thus within a particular embodiment each feature of each like-named component is not necessarily fully elaborated upon.

Approximating language, as used herein throughout the specification and claims, can be applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language can correspond to the precision of an instrument for measuring the value. Here and throughout the specification and claims, range limitations can be combined and/or interchanged, such ranges are identified and include all the sub-ranges contained therein unless context or language indicates otherwise.

One skilled in the art will appreciate further features and advantages of the invention based on the above-described embodiments. Accordingly, the present application is not to be limited by what has been particularly shown and described, except as indicated by the appended claims. All publications and references cited herein are expressly incorporated by reference in their entirety.

The invention claimed is:

1. A system comprising:

a sealed sensor assembly comprising:

a hermetic barrier;

a high voltage sensor, an input circuit configured to provide an input voltage to the high voltage sensor, an output circuit configured to provide an output voltage to a data processor, and a discharge reduction circuit configured within the sealed sensor assembly to receive the input voltage for provision to the high voltage sensor via the input circuit and to provide the output voltage to the data processor via the output circuit, the output voltage indicative of an output signal corresponding to a quantum of light received at the high voltage sensor, wherein the discharge reduction circuit is configured to reduce an incidence of discharge associated with an ionization breakdown of an air gap between the output circuit and a first insulator conveying the output circuit through the hermetic barrier to the data processor.

2. The system of claim 1, wherein the discharge reduction circuit includes a bias resistor and a coupling capacitor.

3. The system of claim 2, wherein the bias resistor is configured between an input of the high voltage sensor and an output of the high voltage sensor.

4. The system of claim 2, wherein the coupling capacitor is configured between an output of the bias resistor and a pin of the first insulator conveying the output circuit through the hermetic barrier of the sealed sensor assembly.

5. The system of claim 1, wherein the high voltage sensor comprises a scintillator and a photocathode and the sealed sensor assembly comprises a photomultiplier tube.

6. The system of claim 5, wherein the photomultiplier tube includes a pressurized gas.

7. The system of claim 1, wherein the input voltage is provided by a high voltage power source coupled to the input circuit.

8. The system of claim 7, wherein the high voltage power source is configured to supply the input voltage between 250-2000 V.

9. The system of claim 1, wherein the sealed sensor assembly comprises a second insulator conveying the input circuit from the high voltage power source through the hermetic barrier.

10. The system of claim 1, wherein the hermetic barrier is formed from a material including one of a silicon dioxide, a magnesium dioxide, a ceramic, or a combination thereof.

11. A method comprising:

receiving an input voltage at a high voltage sensor configured within a sealed sensor assembly, the input voltage received via an input circuit coupling the high voltage sensor and a discharge reduction circuit configured within the sealed sensor assembly, the discharge reduction circuit configured to provide the input voltage to the high voltage sensor; and providing an output voltage of the high voltage sensor via the discharge reduction circuit, the output voltage provided via an output circuit coupling the high voltage sensor to a data processor via the discharge circuit, the output voltage indicative of an output signal corresponding to a quantum of light received at the high voltage sensor, wherein the discharge reduction circuit is configured within the sealed sensor assembly to reduce an incidence of discharge associated with an ionization breakdown of an air gap between the output circuit and a first insulator conveying the output circuit through a hermetic barrier of the sealed sensor assembly to the data processor.

12. The method of claim 11, wherein the discharge reduction circuit includes a bias resistor and a coupling capacitor.

13. The method of claim 12, wherein the bias resistor is configured between an input to the high voltage sensor and an output of the high voltage sensor.

14. The method of claim 12, wherein the coupling capacitor is configured between an output of the bias resistor and a pin of the first insulator.

15. The method of claim 11, wherein the high voltage sensor comprises a scintillator and a photocathode and the sealed sensor assembly comprises a photomultiplier tube.

16. The method of claim 15, wherein the photomultiplier tube includes a pressurized gas.

17. The method of claim 11, wherein the input voltage is provided via a high voltage power source coupled to the input circuit.

18. The method of claim 17, wherein the high voltage power source is configured to supply the input voltage between 250-2000 V.

19. The method of claim 11, wherein the sealed sensor assembly comprises a second insulator conveying the input circuit from the high voltage power source through the hermetic barrier.

20. The method of claim 11, wherein the hermetic barrier is formed from a material including one of a silicon dioxide, a magnesium dioxide, a ceramic, or a combination thereof.

* * * * *